US006375831B1

(12) United States Patent
Doyle et al.

(10) Patent No.: US 6,375,831 B1
(45) Date of Patent: Apr. 23, 2002

(54) INHIBITING DEPOSITS IN COKE OVEN GAS PROCESSING EQUIPMENT

(75) Inventors: Patrick J. Doyle, Chicago, IL (US); Terrence W. Mattioli, Landsdale; Gary S. Thundercliffe, Doylestown, both of PA (US)

(73) Assignee: BetzDearborn Inc., Trevose, PA (US)

( * ) Notice: Subject to any disclaimer, the term of this patent is extended or adjusted under 35 U.S.C. 154(b) by 0 days.

(21) Appl. No.: 09/495,801

(22) Filed: Feb. 1, 2000

(51) Int. Cl.[7] ..... C10G 9/12; C10G 9/16; B08B 9/00; B08B 9/27; B08B 3/00

(52) U.S. Cl. ..... 208/48 AA; 208/48 R; 134/22.11; 134/22.14; 134/22.19; 134/39; 134/40

(58) Field of Search ..... 134/22.11, 22.14, 134/22.19, 39, 40; 208/48 AA, 48 R

(56) References Cited

U.S. PATENT DOCUMENTS 2,448,767 A 9/1948 Carlson
5,225,002 A 7/1993 Stafford et al.

*Primary Examiner*—Walter D. Griffin
*Assistant Examiner*—Tam M. Nguyen
(74) *Attorney, Agent, or Firm*—Steven D. Boyd

(57) ABSTRACT

A method of inhibiting and/or removing deposits from coke oven gas handling equipment is disclosed which comprises the addition of a treatment combination of a heterocyclic nitrogenous compound such as quinoline and 2-butoxyethanol to the flushing liquor used to cool coke oven effluent gases.

5 Claims, No Drawings

INHIBITING DEPOSITS IN COKE OVEN GAS PROCESSING EQUIPMENT

FIELD OF THE INVENTION

The present invention relates to a method of inhibiting deposits on the equipment and in the ducts and pipes carrying the flushing liquor used in the operation of coke ovens. More particularly, the present invention relates to a method of inhibiting deposits in equipment handling flushing liquor in a coke oven system by treating the flushing liquor with quinoline in combination with 2-butoxyethanol.

BACKGROUND OF THE INVENTION

In the operation of coke ovens which produce metallurgical coke from coking coal, deposits can form on the equipment and in the ducts and pipes which carry the coke oven gases. In processing and handling of the volatile coke oven gas evolved from the coal during the coking process, deposits and fouling are common. The gases and vaporized liquids removed as effluent gas in a coking process can include tar, light oil, ammonia liquor etc. Some of the specific products refined from coke ovens include ammonium sulfate, benzene, toluene, xylene, naphtalene, pyridine, phenathrene, anthracene, creosote, road tar, roofing pitches, pipeline enamels, along with many other products. Several hundred individual compounds have been found, organic and inorganic, in the effluent gas from a coking process.

A simplified description of the coking process would be the destructive distillation of a complex carbonaceous mineral. The compounds formed or driven off during the process have a wide range of boiling and melting points and solubilities, causing the selective condensation or crystallization of the higher boiling compounds. In handling and processing the gases driven off during the coking process, fouling of the handling and processing equipment often limits run time for the equipment between shut downs for cleaning.

The coke oven gases from the coke oven are at high temperatures, often about 800° C. These hot gases which leave the coke oven by way of standpipes pass through goosenecks at the top of the standpipes where the gases are cooled by flushing liquor. The flushing liquor cools the gases from about 800° C. to about 800° C. so that the gases can be safely handled by the downstream collector main and gas processing equipment. The cooling also condenses tar and tar-mist vapors which are then carried by the flushing liquor along the collector main to a tar-liquor seal which directs the tar to decanters or predecanters where tar is recovered. The flushing liquor also carries solid coal, coke and cracked carbon particles from the gas stream and into the tar to the decanters. The flushing liquor also dissolves nearly all of the ammonium salts and much of the free ammonia thereby reducing the contaminant levels in the coke oven gas.

The flushing liquor which passes through the tar-liquor seal is "contaminated" by the multitude of organic and inorganic materials present in the gases driven off during coking. The flushing liquor typically is treated in an ammonia recovery system. The presence of these contaminates leads to fouling of the goosenecks, collection mains and the ammonia recovery system with deposits.

SUMMARY OF THE INVENTION

The present inventors have discovered that treatment of the flushing liquor with a heterocyclic nitrogenous compound in combination with 2-butoxyethanol can inhibit fouling deposits in the lines, conduits and equipment handling the flushing liquor thereby significantly extending run time between shut downs for cleaning. Addition of a heterocyclic nitrogenous compound such as quinoline in combination with 2-butoxyethanol such as Butyl Cellosolve® (Cellosolve is a registered trademark of Union Carbide Corporation) to the flushing liquor has been found to inhibit the formation of undesirable deposits on the lines, conduit and equipment which come into contact with the flushing liquor. It is also believed that the treatment combination, when added to the flushing liquor, can also result in removal of already formed deposits.

DETAILED DESCRIPTION OF THE PREFERRED EMBODIMENTS

A method of inhibiting and dissolving deposits on conduits, lines and equipment handling flushing liquor in a coke oven plant is disclosed. The method comprises adding to flushing liquor in a coke oven plant, a heterocyclic nitrogenous compound and 2-butoxyethanol in an amount sufficient to inhibit and/or dissolve undesirable deposits. Preferably, the treatment combination is added to the flushing liquor prior to the goosenecks at the top of the coke oven standpipes where the flushing liquor first contacts the coke oven effluent gases.

The heterocyclic nitrogenous compound of the treatment combination of the present invention is preferably quinoline of the general formula:

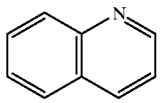

The 2-butoxyethanol compound of the treatment combination of the present invention is available as Butyl Cellosolve® from the Union Carbide Corporation. The ratio of heterocyclic nitrogenous compound to 2-butoxyethanol can range from about 50:50 to about 10:90 by weight percent. The preferred ratio is about 25:75 weight percent.

The treatment combination is added to the flushing liquor in an amount sufficient to inhibit deposit formation in the conduits, lines and equipment which the flushing liquor comes into contact with. Typical flushing liquor treatment combination concentrations can range from 0.5 to 5.0 parts per million.

In an operating coke plant, fouling of the conduits, lines and ammonia stills which contacted flushing liquor resulted in a short run life between shut downs for cleaning of about three weeks. Upon addition of 5 parts per million of a combination of quinoline and Butyl Cellosolve® in a ration of 25:75 percent by weight to the flushing liquor to the ammonia still, the run life between shut downs for cleaning increased to several months.

What is claimed is:

1. A method of inhibiting fouling deposit formation in conduits, lines and equipment in contact with flushing liquor in a coke oven plant comprising adding to said flushing liquor a treatment combination of a heterocyclic nitrogenous compound and 2-butoxyethanol in an amount sufficient to inhibit fouling deposit formation.

2. The method of claim 1 where in the ratio of heterocyclic nitrogenous compound to 2-butoxyethanol in said treatment combination is from 50:50 to 10:90 percent by weight.

3. The method of claim 1 wherein the ratio of heterocyclic nitrogenous compound to 2-butoxyethanol in said treatment combination is 25:75 percent by weight.

4. The method of claim 1 wherein said heterocyclic nitrogenous compound is quinoline.

5. The method of claim 1 wherein said treatment combination is added to said flushing liquor in a concentration of from about 0.5 parts per million to 5.0 parts per million.

* * * * *